US006601636B1

(12) United States Patent
Liu

(10) Patent No.: US 6,601,636 B1
(45) Date of Patent: Aug. 5, 2003

(54) SLAT ANGLE ADJUSTING DEVICE FOR VENETIAN BLIND

(76) Inventor: Tai-Ping Liu, No. 15, Alley 8, Lane 3, Kuo-Chi St., Lung-Ching Hsiang, Taichung Hsien (TW)

( * ) Notice: Subject to any disclaimer, the term of this patent is extended or adjusted under 35 U.S.C. 154(b) by 0 days.

(21) Appl. No.: 10/151,862

(22) Filed: May 22, 2002

(51) Int. Cl.[7] ..... E06B 9/38
(52) U.S. Cl. ..... 160/177 R
(58) Field of Search ..... 160/177 R, 176.1 R, 160/168.1 R, 173 R, 172 R, 170 R, 171 R, 178.1 R, 115, 107

(56) References Cited

U.S. PATENT DOCUMENTS 3,156,295 A * 11/1964 Vecchiarelli et al. .. 160/176.1 R
3,269,453 A * 8/1966 Vecchiarelli et al. .. 160/176.1 R
3,333,905 A * 8/1967 Hennequin ..... 160/177 R
3,357,270 A * 12/1967 Spangenberg ..... 160/177 R
5,538,068 A * 7/1996 Liu ..... 160/177 R
5,636,677 A * 6/1997 Liu ..... 160/177 R
5,680,892 A * 10/1997 Liu ..... 160/177 R

* cited by examiner

*Primary Examiner*—David Purol
(74) *Attorney, Agent, or Firm*—Venable, LLP; Fei-Fei Chao

(57) ABSTRACT

A slat angle adjusting device has a body, a roller, a transmission device and a positioning bar. The roller is rotatably attached to the body for a cord being wound around the roller. The transmission device is received in the body and operationally connected to the roller. The positioning bar is integrally formed on the top of the body and has two forked ends adapted to engage with upper bent portions of a headrail of the Venetian blind. Each forked end has an upper tongue and a lower tongue respectively adapted for abutting the top and the bottom of the bent portion on the headrail. The lower tongue has a length shorter than a half of the length of the upper tongue. Accordingly, the body is easily assembled to the headrail with the positioning bar.

1 Claim, 4 Drawing Sheets

SLAT ANGLE ADJUSTING DEVICE FOR VENETIAN BLIND

BACKGROUND OF THE INVENTION

1. Field of the Invention

The present invention relates to a slat angle adjusting device, and more particularly to a slat angle adjusting device for a Venetian blind.

2. Description of Related Art

The closest prior art of which the applicant is aware is disclosed in the applicant's U.S. Pat. No. 5,680,892, filed on Jul. 31, 1996, entitled "SLAT ANGLE ADJUSTING DEVICE FOR VENETIAN BLIND". With reference to FIG. 4, the conventional slat angle adjusting device for a Venetian blind referred to in the '892 patent comprises a body (50), and a roller (54). The body (50) is securely positioned to the headrail (70) of the Venetian blind for the tilt rod (72) extending through the body (50). A transmission device (not shown) is arranged in the body (50) and is connected to the tilt rod (72). The roller (54) is rotatably attached to the body (50) and is operationally connected to the transmission device. A cord (60) is wound around the,roller (54) and extends through a base (56) and the headrail (70). When the user pulls the cord (60), the tilt rod (72) will rotate through the transmissions of the roller (54) and the transmission device. Consequently, the angle of the slats of the Venetian blind will be adjusted.

A positioning bar (52) is formed on the top of the body (50) to securely position the body (50) to the headrail (70). Two C-shaped forked ends (522) are formed on the opposite ends of the positioning bar (52) to engage two upper bent portions of the headrail (70). Each forked end (522) has an upper tongue (524) abutting the top of the bent portion of the headrail (70) and a lower tongue (526) abutting the bottom of the bent portion of the headrail (70).

However, because the length of the lower tongue (526) of the forked end (522) on the positioning bar (52) of the conventional adjusting device is substantially equal to that of the upper tongue (526), to assemble the body (50) to the headrail (70) with the positioning bar (52) is difficult. In addition, a notch (542) is defined in each respective side of the roller (54) to engage a knot (not numbered) formed on the cord (60), such that the cord (60) can be securely held onto the roller (54). Nevertheless, the positioning effect between the notch (542) and the knot on the cord (60) is not enough for common use, and there is no structure on the roller (54) of the conventional adjusting device to provide a further positioning effect to the cord (60). When the user pulls the cord (60) with a large force, the knot can release from the notch (54).

To overcome the shortcomings, the present invention tends to provide a slat angle adjusting device to mitigate or obviate the aforementioned problems.

SUMMARY OF THE INVENTION

The main objective of the invention is to provide a slat angle adjusting device for a Venetian blind and that is easy to assemble to the headrail. The slat angle adjusting device has a body, a roller, a transmission device and a positioning bar. The roller is rotatably attached to the body for a cord being wound around the roller. The transmission device is received in the body and operationally connected to the roller. The positioning bar is integrally formed on the top of the body and has two forked ends adapted to engage with upper bent portions of a headrail of the Venetian blind. Each forked end has an upper tongue and a lower tongue respectively adapted for abutting the top and the bottom of the bent portion on the headrail. The lower tongue has a length shorter than a half of the length of the upper tongue. Accordingly, to assemble the body to the headrail with the positioning bar is easy due to the length arrangement of the lower tongue.

Other objects, advantages and novel features of the invention will become more apparent from the following detailed description when taken in conjunction with the accompanying drawings.

DETAILED DESCRIPTION OF PREFERRED EMBODIMENT

Figure 1:
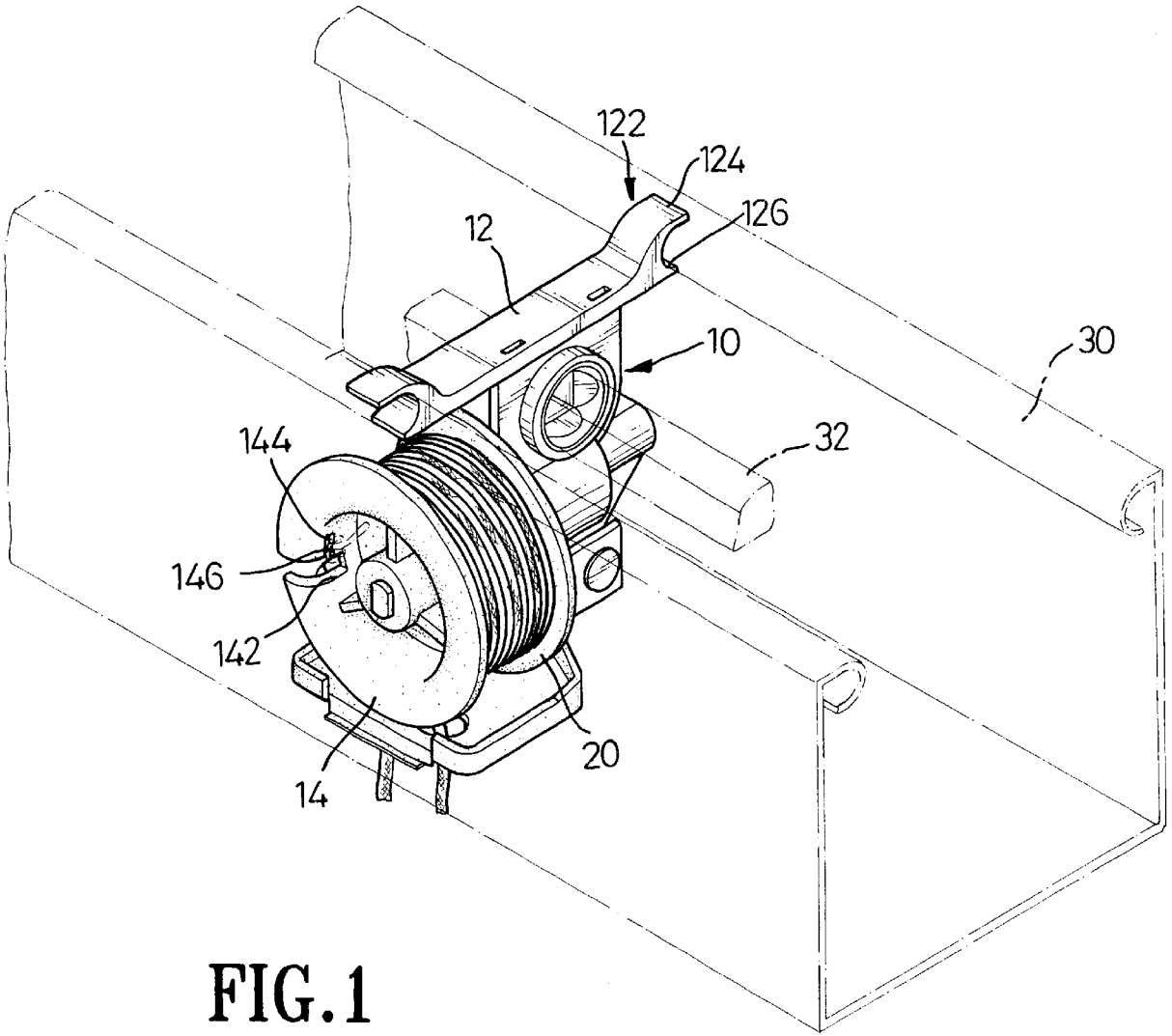
FIG. 1 is a perspective view of a slat angle adjusting device in accordance with the present invention.
Figure 2:
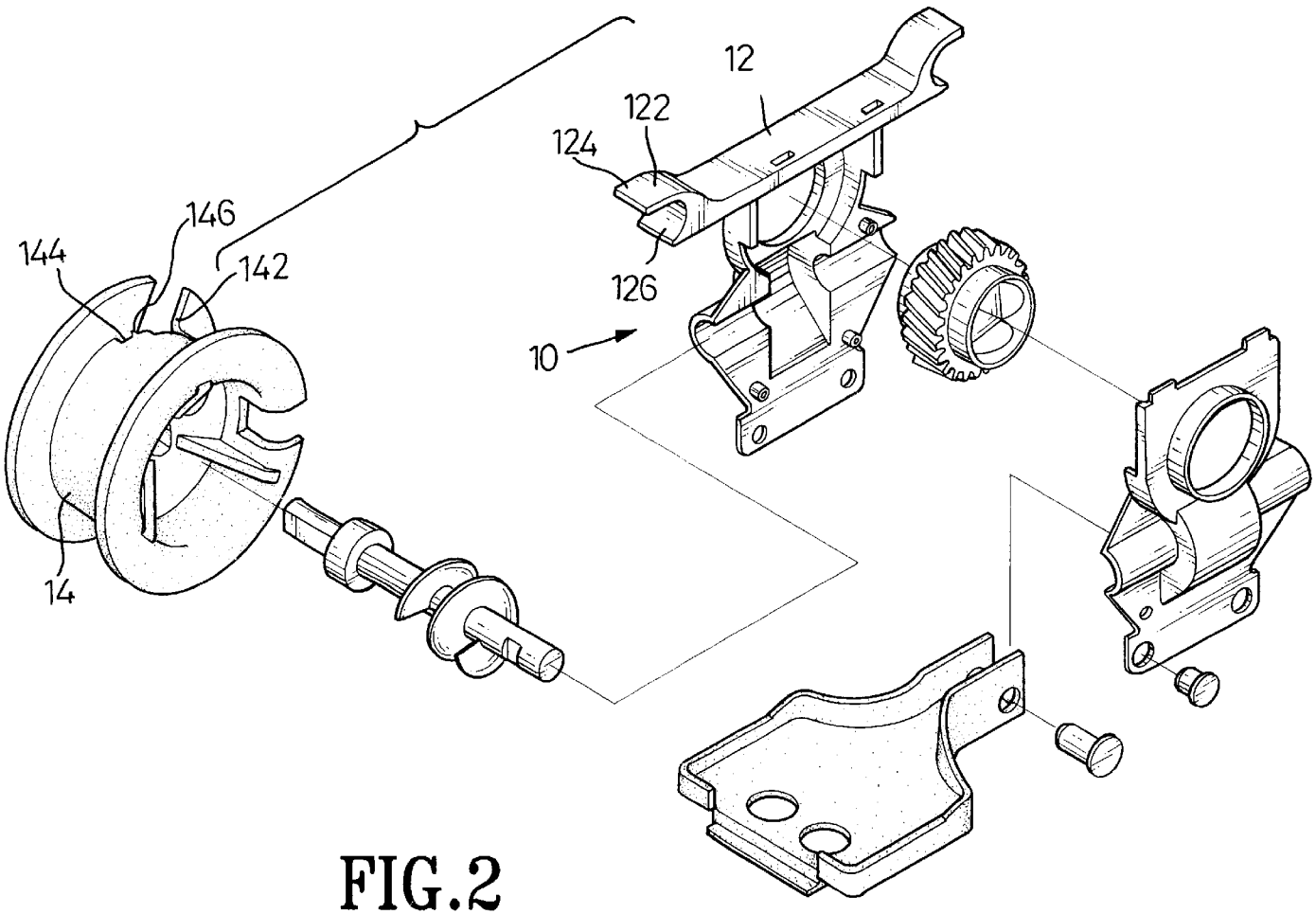
FIG. 2 is an exploded perspective view of the slat angle adjusting device in FIG. 1.
Figure 3:
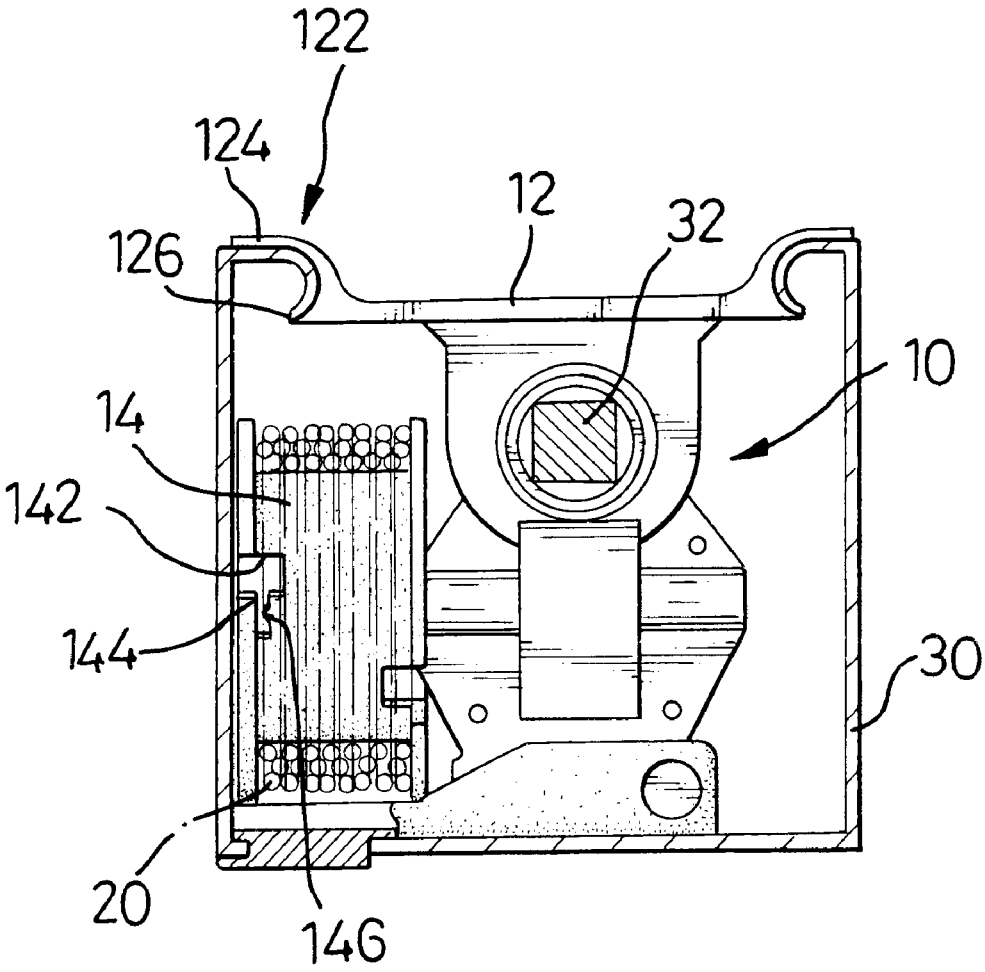
FIG. 3 is a side plan view in partial cross section of a headrail with the slat angle adjusting device in FIG. 1.
Figure 4:
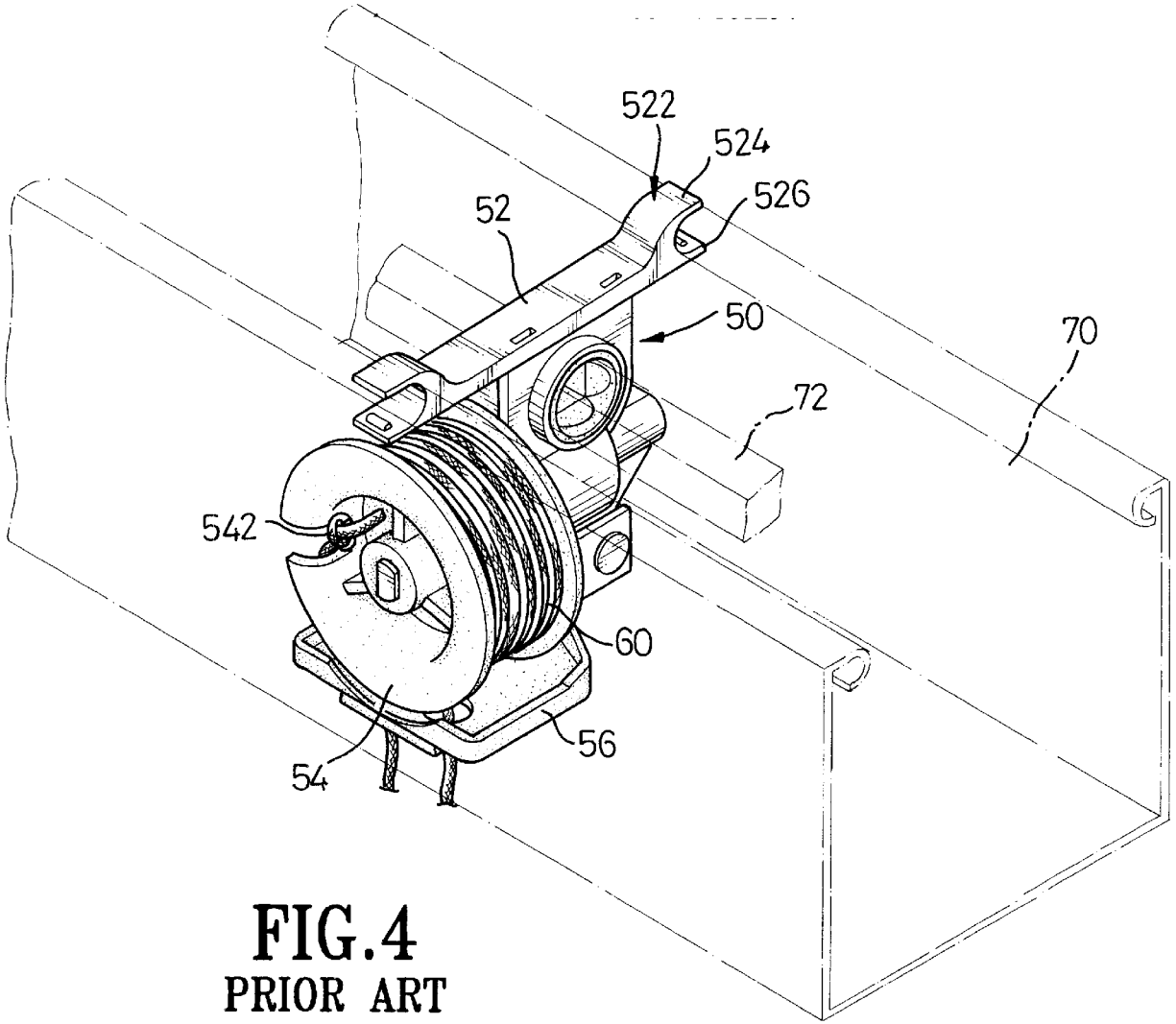
FIG. 4 PRIOR ART
FIG. 4 is a perspective view of a conventional slat angle adjusting device in accordance with the prior art.

With reference to FIGS. 1 to 3, a slat angle adjusting device for a Venetian blind in accordance with the present invention comprises a body (10), a positioning bar (12), a roller (14) and a transmission device. The body (10) is hollow, and in practice, composed of two half covers. The positioning bar (12) is integrally formed on the top of the body (10) and has two C-shaped forked ends (122) for engaging with upper bent portions of a headrail (30) of the Venetian blind. Each forked end (122) has an upper tongue (124) and a lower tongue (126). The upper tongue (124) of the forked end (122) is adapted to abut the top of the corresponding bent portion of the headrail (30), and the lower tongue (126) is adapted to abut the bottom of the corresponding bent portion of the headrail (30). Wherein, the lower tongue (126) of each forked end (122) has a length shorter than a half of the length of the upper tongue (124). With the positioning bar (12), the body (10) is securely positioned in the headrail (30) of the Venetian blind.

The roller (14) is rotatably attached to the body (10) for a cord (20) being wound around the roller (14). Two notches (142) are defined in opposite sides of the roller (14) to respectively hold two knots (not numbered) of the cord (20) in place. A recess (144) is defined in each respective side of the roller (14) and communicates with the corresponding one of the notches (142). A protrusion (146) is formed on an inner side of each respective recess (144). Accordingly, a portion of the cord (20) near the knot can be received in the recess (144) and is stopped by the protrusion (146). The protrusion (146) can keep the cord (20) from releasing from the recess (144) even when a large force is applied to the cord, thus the combination between the cord (20) and the roller (14) is enhanced.

The transmission device is mounted in the body and is operationally connected to the roller and the tilt rod (32) of the Venetian blind. In practice, the transmission device comprises a worm (not numbered) connected to the roller and a pinion (not numbered) engaging with the worm and connected to the tilt rod (32). Accordingly, when the cord is pulled, the tilt rod (32) will rotate through the transmissions of the roller and the transmission device.

With such an arrangement, because the lower tongue (126) of the forked end (122) is shorter than the upper tongue (124), to assemble the body (10) to the headrail (30) with the positioning bar (12) is convenient. To assemble the slat angle adjusting device to the headrail (30) is convenient.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A slat angle adjusting device for Venetian blind comprising:

a body;

a roller rotatably attached to the body for a cord being wound around the roller and having two notches defined in opposite sides of the roller to respectively hold in place two knots formed on the cord;

a transmission device received in the body and operationally connected to the roller;

a positioning bar integrally formed on a top of the body and having two forked ends adapted to engage with upper bent portions of a headrail of the Venetian blind, each forked end having an upper tongue adapted to abut a top of the corresponding one of the bent portions of the headrail and a lower tongue adapted to abut a bottom of the corresponding one of the bent portions of the headrail;

a recess defined in each respective side of the roller and communicating with the corresponding one of the notches in the roller to engage with the cord so as to hold the cord in place; and a protrusion formed on an inner side of each respective recess to keep the cord from releasing from the recess, wherein the lower tongue of each one of the forked ends has a length shorter than a half of a length of the upper tongue of the forked end.

* * * * *